United States Patent [19]

Garnreiter

[11] Patent Number: 4,796,434

[45] Date of Patent: Jan. 10, 1989

[54] APPARATUS FOR DELIVERING A MEASURED AMOUNT OF A LOW-BOILING LIQUEFIED GAS

[76] Inventor: Franz Garnreiter, Föhrenstrasse 26, D-8206 Bruckmühl, Fed. Rep. of Germany

[21] Appl. No.: 126,217

[22] Filed: Nov. 25, 1987

[30] Foreign Application Priority Data

Dec. 10, 1986 [DE] Fed. Rep. of Germany ..... 3642199

[51] Int. Cl.[4] ..... F17C 7/02

[52] U.S. Cl. ..... 62/55; 62/49; 141/97; 141/286; 210/460; 210/496; 222/189

[58] Field of Search ..... 62/45, 49, 50, 55; 141/97, 286; 210/460, 496; 222/189

[56] References Cited

U.S. PATENT DOCUMENTS 3,295,563 1/1967 Laya et al. ..... 62/55
4,175,395 11/1979 Prost et al. ..... 62/55
4,279,626 7/1981 Buchmuller et al. ..... 62/55
4,490,984 1/1985 Hongo et al. ..... 62/55
4,566,283 1/1986 Boese ..... 62/50
4,586,343 5/1986 Buschkens et al. ..... 62/55

*Primary Examiner*—Ronald C. Capossela
*Attorney, Agent, or Firm*—Herbert Dubno

[57] ABSTRACT

The apparatus for providing a measured amount of a low boiling liquefied gas which can flow from an outlet of a thermally insulated container includes a fleece made of natural material, plastic material or metal connected with the outlet of the container, advantageously located immediately downstream of the outlet. This fleece provides a satisfactory separation of liquid and gas phases and thus a laminar liquefied gas flow and can assist in preventing freezing at the outlet due to moisture in the air. Advantageously a precise regulating valve which is sunk in the liquefied gas in the supply container provides continuous regulation of the liquefied gas flow.

7 Claims, 1 Drawing Sheet

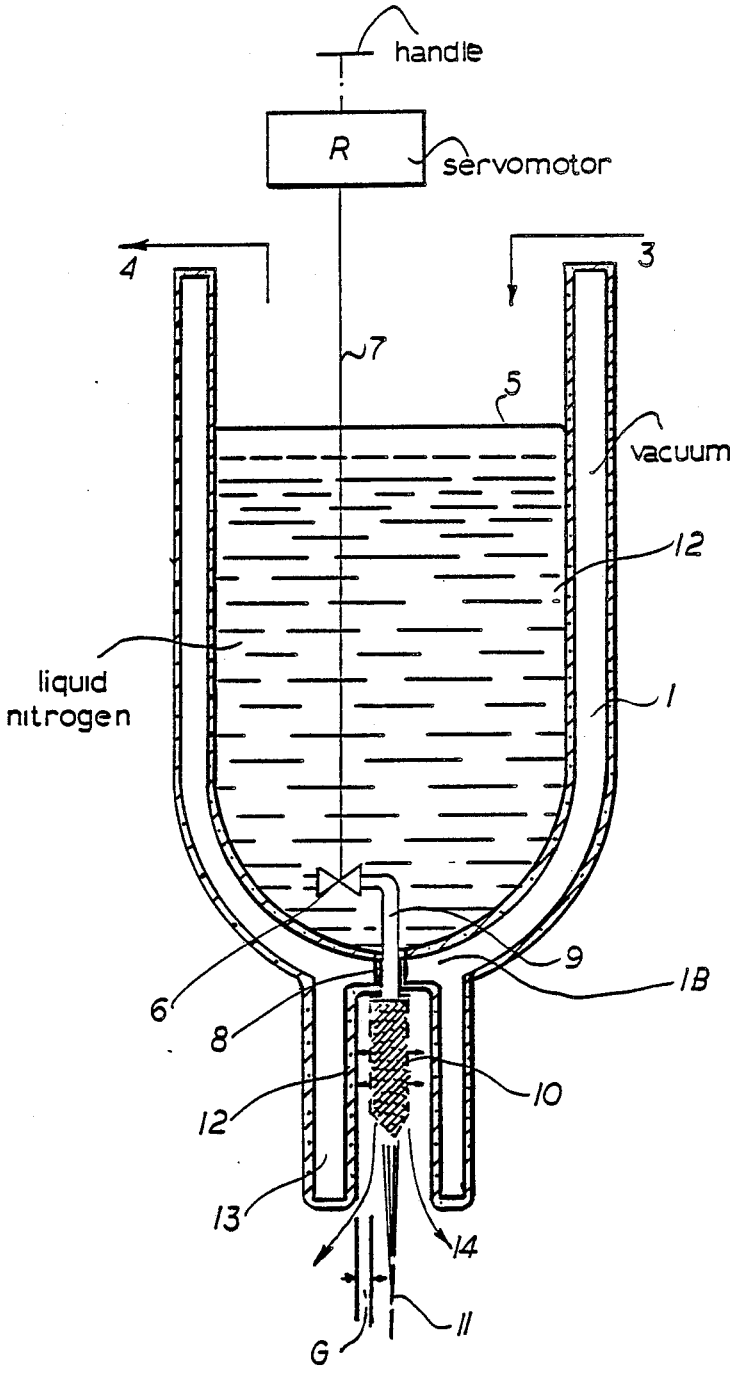
handle
R
servomotor
4
3
7
5
vacuum
12
liquid
nitrogen
1
9
1B
6
8
10
12
13
14
11
G

APPARATUS FOR DELIVERING A MEASURED AMOUNT OF A LOW-BOILING LIQUEFIED GAS

FIELD OF THE INVENTION

My present invention relates to an apparatus for delivering a measured amount of a low-boiling liquefied gas, especially liquid nitrogen.

BACKGROUND OF THE INVENTION

An apparatus for delivering a measured amount of a low-boiling liquefied gas is known in which the liquefied gas can flow from an outlet of a thermally insulated cryogenic container.

Low-boiling liquefied gas is stored customarily in a thermally insulated cryogenic container and can be drawn off through an outlet. Particularly small quantities of low-boiling liquid gas may be measured out only with considerable difficulty because the gas arising at the outlet interrupts the continuous liquefied gas flow. Hence expensive devices were developed to attain a continuous liquefied gas flow for a measured small quantity of liquefied gas.

Thus a device according to German Pat. No. 34 02 292 for delivering a measured small amount of low-boiling liquefied gas is known in which the liquefied gas is located in one container which is surrounded by a second container so that an intermediate space arises between the containers. The liquefied gas can be drawn from the container through an outlet. Cold gas issues from the inner to the outer container and cools the entire apparatus so that the liquefied gas found in the inner container receives a minimum of heat from the exterior. The cold gas leaves the container by a gas outlet in the vicinity of the fluid outlet for the liquefied gas so that it surrounds the liquefied gas flowing out of the container. To confine the liquefied gas flowing out, a gas cushion is formed under an elevated pressure corresponding at least to the total gas pressure existing in the surroundings in the vicinity of the outlet.

A device for delivery of an uninterrupted stream of a cryogenic liquefied gas is known and described in German Open Patent Application No. 34 19 855. This device is connected with a delivery pipe and a degassing device downstream by a pressure regulator containing the cryogenic liquefied gas. Free liquefied gas leaves the degassing device while cold gas is conducted to a different location. Consequently an unbroken stream of cryogenic liquefied gas can be generated.

All known devices for delivering a measured amount of a liquefied gas, particularly for a small quantity, which deliver a continuous fluid flow are comparatively expensive.

OBJECTS OF THE INVENTION

It is an object of my invention to provide an improved apparatus for delivering a measured amount of a liquefied gas which will obviate the aforementioned drawbacks.

It is also an object of my invention to provide an improved apparatus for delivering a measured amount of a liquefied gas, particularly a small amount, which can flow from an outlet of a thermally insulated cryogenic container constructed so that without substantially increased expense an accurately measured laminar flow of liquefied gas can be drawn from the apparatus.

SUMMARY OF THE INVENTION

These objects and others which will become more readily apparent hereinafter are attained in accordance with my invention in an apparatus for delivering a measured amount of a liquefied gas which can flow from an outlet of a thermally insulated container.

According to my invention a fleece made of natural material, plastic or other synthetic material or metal is connected with and advantageously lies immediately downstream of the outlet of the container. A "fleece" in the sense of the invention, is a coherent body of matted fibers, filaments or threads or wires with interconnected interstices.

My invention includes a thermally insulated container, advantageously a cryogenic container such as a Dewar flask, for the liquefied gas. At the lower end of the container an outlet for the liquefied gas is provided with a fleece of natural material, plastic material or metal. The container is filled with liquefied gas, particularly liquid nitrogen. The liquefied gas is fed through the outlet to the plastic, metal or natural fleece and leaves the device in a laminar stream.

The liquefied gas found in the container flows through the outlet opening into the fleece. In the fleece a separation of the liquid and gas phase occurs so that a laminar flow of liquefied gas substantially vertically downward is delivered while the cold gas is conducted away laterally from the plastic, metal or natural fleece. The cold gas does not disturb the laminar liquefied gas flow so that a precise small amount of liquefied gas can be provided.

A variety of specific forms of my invention are possible. The fleece is advantageously substantially cylindrically shaped with a point on the end opposite the end adjacent or closest to the outlet of the container.

In this way a laminar downwardly directed liquefied gas stream is provided which is particularly suitable for delivering small amounts of liquefied gas. The cold gas is directed horizontally by the cylindrical fleece uniformly distributed over the cylindrical surface.

In a particularly advantageous feature of my invention, the fleece is surrounded by a substantially cylindrical shroud open at its end furthest from the outlet so that a gap around the fleece of about 2 to about 30 mm (radial gap width) is present. This shroud ensures that the cold gas conducted away from the fleece will be deflected downwardly. So the shroud surrounds the plastic or metal fleece and the liquefied gas flowing downwardly. This prevents the admission of moist air to the fleece and thus freezing up and deposit of ice are prevented.

A precision regulating valve submerged in the liquefied gas is appropriately mounted adjacent the bottom of the container. This precision regulating valve is connected with the outlet and with a regulating device (i.e. a valve-controlling servomotor) located outside the container. This allows continuous metering of the amount of the liquefied gas issuing from the outlet and thus a precise control of the laminar liquefied fluid flow delivered from the fleece. Since the precise regulating valve is submerged in the liquefied gas freezing of the valve is prevented. The fine regulating valve can alternatively or in addition be controlled by hand by a simple rod or bar which is connected with the valve and projects from the container.

However it has proved especially suitable to control the precision regulating valve by the servomotor which is connected to it (i.e. the regulating device outside the container comprises a remotely controlled motor). In this way the apparatus can be automated. Thus a predetermined amount of liquefied gas can be metered into a unit for food packaging, beverage filling or the like units located under the apparatus.

The apparatus according to my invention has in contrast to the conventional metering device for liquefied gases the advantage that a precise metering of small amounts of low-boiling liquefied gas is possible. A satisfactory separation of fluid and gas phases occurs in the fleece of my invention thus delivering a suitable laminar liquefied gas flow. A continuous regulation of the liquefied gas volume in the desired region is possible using the precise regulating valve submerged in the liquefied gas.

The apparatus according to my invention is suitable for delivering a measured small quantity of liquefied gas, particularly liquid nitrogen. Liquid nitrogen is used particularly in the food packaging industry. Nitrogen often serves as an inert gas in food packaging. Frequently the liquefied gas can produce a certain definite interior pressure after closing the package to increase the resistance or strength of the package, e.g. for stacking the packages over each other.

Accordingly with the apparatus of my invention a precise small quantity of liquefied gas, e.g. liquid nitrogen, can be provided to a food packaging unit. By operating a precise regulating valve with an adjustable motor, a predetermined amount of liquefied nitrogen can automatically be provided, e.g. in a beverage filling machine with a high working speed.

BRIEF DESCRIPTION OF THE DRAWING

The above and other objects, features and advantages of my invention will become more readily apparent from the following description, reference being made to the accompanying highly diagrammatic drawing in which the sole FIGURE is a schematic vertical cross sectional view of an apparatus for delivering a measured amount of a low-boiling liquefied gas according to my invention.

SPECIFIC DESCRIPTION

The apparatus in the drawing comprises a thermally insulated vacuum container or Dewar flask 1 which receives a low-boiling liquefied gas 2. The container or Dewar flask 1 is open on top so that fresh liquefied gas can be fed in from above and vapors can escape. By standard automatic regulation the liquefied gas level 5 can be maintained constant by control of the liquefied gas input.

A precision regulating valve 6 is positioned at the bottom lb of the Dewar or vacuum container 1 submerged in the liquefied gas 2. It is accessible to a regulating device R positioned outside of the container I shown in the drawing with a block only by a rigid connecting member 7. The precision regulating valve 6 can be controlled also by hand by the rigid connecting member 7.

An outlet 8 for the liquefied gas 2 is provided at the lower end of the Dewar or container 1. A pipe 9 for the liquefied gas 2 which is connected with the precision regulating valve 6 passes through the outlet 8 and ends at a fleece 10 made of natural material, plastic material or metal. The fleece 10 is cylindrical and comes to a point at its bottom so that a thin laminar liquefied gas stream 11 is delivered when the precision regulating valve 6 is open. The cold gas however escapes laterally from the fleece 10.

The fleece 10 is surrounded by a shroud 13 so that a gap G around the fleece of about 15 mm is present between the fleece 10 and the shroud 13. Because of that cold gas 12 escaping laterally from the fleece 10 is deflected downwardly according to the arrows 14 and surrounds the fleece 10 so that admission of moist air is avoided and thus freezing is prevented.

In this example of my invention the regulating device R outside the vacuum container 1 comprises a servomotor with a remote controller (not shown) and the rigid connecting member 7 can be a connecting rod driven by the shaft of the adjustable motor directly or through a transmission or gear box.

The width of the gap G between the shroud 13 and the fleece 10 can be from about 2 to about 30 mm.

I claim:

1. An apparatus for metering or delivering a measured amount of a low-boiling liquefied gas comprising:

a thermally insulated container provided with an outlet for said liquefied gas;

a cylindrically shaped fleece made of natural material, plastic material or metal connected with said outlet extending immediately downstream of said outlet coming to a point on the side of said fleece furthest from the side of said fleece adjacent or closest said outlet of said container;

a cylindrical shroud for said fleece open at the end of said shroud furthest from said outlet so that a gap is present between said fleece and said shroud; and a precision regulating valve submerged in said liquefied gas mounted adjacent the bottom of said container, said precision regulating valve being connected with said outlet and being connectable to a regulating device located outside of said container.

2. An apparatus according to claim 1 wherein said regulating device outside said container comprises an adjustable motor and said gap is from about 2 mm to about 30 mm.

3. In an apparatus for delivering a measured amount of a low-boiling liquefied gas which can flow from an outlet of a thermally insulated container, the improvement comprising a fleece made from a substance selected from the group consisting of natural material, plastic material and metal connected to said outlet of said container and wherein said fleece is surrounded by a substantially cylindrical shroud open at the end of said shroud furthest from said outlet so that a gap of from about 2 to 30 mm is present between said fleece and said shroud.

4. The improvement according to claim 3 wherein a precision regulating valve submerged in said liquefied gas is mounted adjacent the bottom of said container, said precision regulating valve being connected with said outlet and with a regulating device positioned outside of said container.

5. The improvement according to claim 4 wherein said regulating device comprises an adjustable motor.

6. A method of dispensing a measured amount of a liquefied gas, comprising the steps of:

(a) storing a liquefied gas in an insulated vessel;

(b) controlled by releasing said liquid gas in a stream through an outlet opening into said vessel below a surface of liquid therein;

(c) passing said stream downwardly through a cylindrical downwardly pointed fleece so that a continuous liquid stream is discharged downwardly and cold gas flows horizontally outwardly; and (d) enclosing said cold gas in a shroud preventing access of ambient moisture to said fleece.

7. In an apparatus for delivering a measured amount of a low-boiling liquified gas which can flow from an outlet of a thermally insulated container, the improvement comprising a fleece made from a substance selected from the group consisting of natural material, plastic material and metal connected to said outlet of said container wherein said fleece is substantially cylindrically shaped and comes to a point at a downstream side of said fleece.

* * * * *